United States Patent [19]

Pertschuk

[11] Patent Number: 4,457,510

[45] Date of Patent: Jul. 3, 1984

[54] EXERCISING APPARATUS

[76] Inventor: Daniel M. Pertschuk, 1349 Camino Del Mar, Del Mar, Calif. 92014

[21] Appl. No.: 416,924

[22] Filed: Sep. 13, 1982

[51] Int. Cl.[3] ..... A63B 23/02

[52] U.S. Cl. ..... 272/93; 128/DIG. 15; 2/DIG. 6; 273/DIG. 30

[58] Field of Search ..... 272/144, 145, 93, 119; 273/DIG. 18, DIG. 25, DIG. 30; 128/DIG. 15; 2/DIG. 6; 36/25 R, 59 C, 59 R

[56] References Cited

U.S. PATENT DOCUMENTS

| | | | |
|---|---|---|---|
| 2,050,652 | 8/1936 | Fleming | 272/93 |
| 2,425,971 | 8/1947 | Walker | 272/144 |
| 3,032,345 | 5/1962 | Lemelson | 128/DIG. 15 |
| 3,099,884 | 8/1963 | Kixmiller | 2/DIG. 6 |
| 3,287,016 | 11/1966 | Mayer | 272/144 |
| 3,490,766 | 1/1970 | Gardner | 273/DIG. 30 |
| 3,710,790 | 7/1973 | Lemon | 128/DIG. 15 |
| 3,895,795 | 7/1975 | Merz | 272/DIG. 5 |
| 4,182,510 | 1/1980 | Lundell | 272/93 |
| 4,212,458 | 7/1980 | Bizilla | 272/93 |
| 4,230,103 | 10/1980 | Cote | 128/DIG. 15 |

FOREIGN PATENT DOCUMENTS

| | | | |
|---|---|---|---|
| 2032785 | 5/1980 | United Kingdom | 273/DIG. 30 |

OTHER PUBLICATIONS

Coach and Athlete, Item No. 199, Mar. 1982.

*Primary Examiner*—Richard J. Johnson

[57] ABSTRACT

To support the feet of a user during ninety-degree bent-knee situps, a semi rigid panel is secured to a wall above the floor and a pair of juxtaposed Velcro hook-type patches are secured to the face of the panel. Conventional elastic foot-ankle supports or anklets are put on the feet but reversed with longer portions on the feet and a pair of Velcro loop-type patches are secured to the soles of the anklets to detachably engage with the patches on the wall.

11 Claims, 7 Drawing Figures

EXERCISING APPARATUS

BRIEF SUMMARY OF THE INVENTION BACKGROUND AND OBJECTIVES

My invention relates to apparatus useful in exercising and, more particularly, to apparatus useful in bent-knee situps to secure the feet to a wall or the like above the floor level.

Bent-knee situps are also known as hip-flexed or right-angle situps. They are defined as any situp in which the hip is flexed preferably to ninety degrees with respect to the trunk, bringing the origin and insertion of the iliopsoas muscle into proximity, thereby nullifying its contribution to the act of sitting up.

Benefits of the bent-knee situp are twofold. First, situps performed in this manner more efficiently tone and strengthen the rectus abdominis muscle, i.e., that muscle responsible for a flat appearance of the abdomen. Second, bent-knee situps do not accentuate lumbar lordosis which contributes to malalignment of the vertebral column and low back pain. In fact, only bent-knee situps are recommended for patients with a history of back problems.

In bent-knee situps, the patient should lie on the floor on his or her back with knees bent at right angles with shins parallel to the floor. It is an objective of my invention to provide means to hold the feet in place against a wall, door or other vertical surface when the knees are so bent and when the shins are so positioned.

In other prior mechanisms for doing bent-knee situps, the person has hooked his or her feet under a bar or ledge and, as a result, the knee and hip are flexed forty-five degrees as opposed to the preferable ninety degrees. It is a further object of my invention to provide apparatus facilitating bending the knees at ninety degrees and positioning the shins parallel to the floor for doing bent-knee situps.

Other objectives include: to provide economical, well functioning apparatus adapted both for marketing factors, such as cost and packaging, and for operating considerations, such as ease of use, ease of installation, ease of foot attachment and detachment, etc.

My invention will be best understood, together with additional advantages and objectives thereof, when read with reference to the drawings.

DRAWINGS

DESCRIPTION

Figure 1:
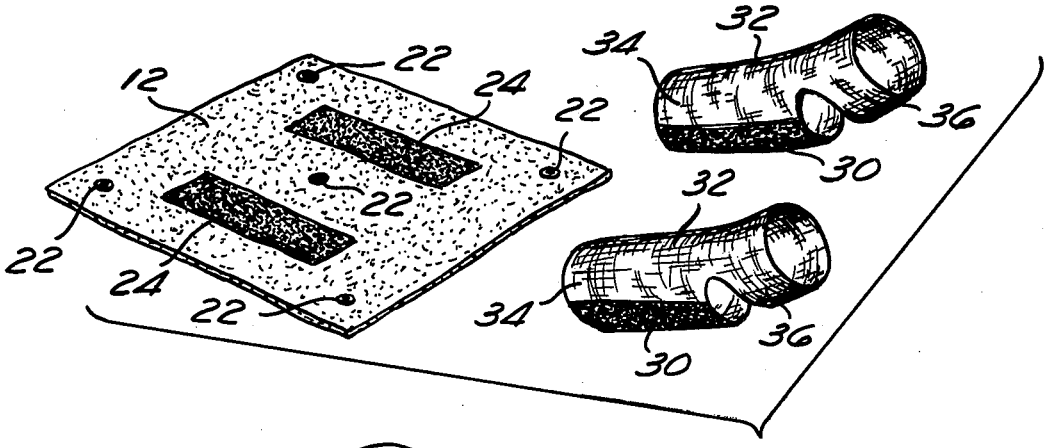
FIG. 1 is an exploded perspective view of a specific embodiment of my invention.
Figure 2:
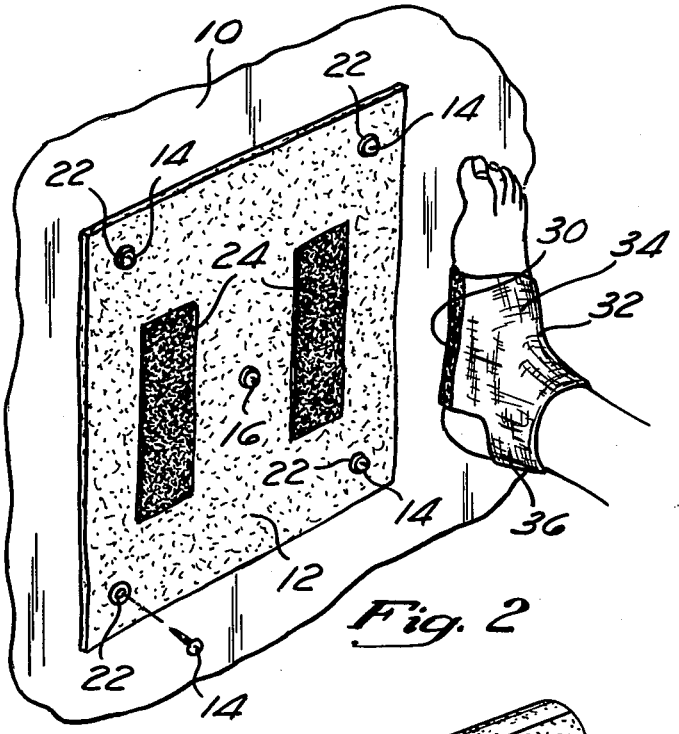
FIG. 2 is a partial perspective view showing securement of one part of the apparatus to a wall and attachment of another part to the foot of a user.

My invention utilizes a material best known by the trademark "Velcro" and defined in the > Manual of Patent Examining Procedure as "synthetic materials which adhere when pressed together". As will be understood by those skilled in the art, when I use the expression "Velcro" in the specification and claims, I mean to cover the type of material that has been manufactured and sold to data under the trademark "Velcro", or any material constructed or operating like Velcro but sold under another trademark, or any equivalent two-part mating material which mechanically adheres when pressed together but which can be forced apart.

My invention concerns securing one of two mating Velcro parts to a wall or the like and securing second mating Velcro parts to the feet to hold the feet with the knees about ninety degrees during bent-knee situps.

One part of the apparatus can be secured to a wall or the like, i.e., the wall of a room, a door of a room, or some other generally vertical surface, such as one specifically constructed for this purpose in a gym or the like, which could be free-standing from room walls. In the drawings, vertical surface 10 can be taken to be a wall, and particularly a plasterboard or plaster wall to which it is difficult to fasten.

Figure 3:
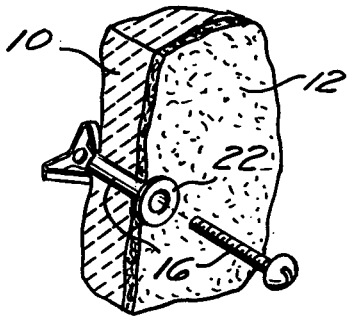
FIG. 3 is an enlarged, partial, exploded perspective view of a central fastener to attach a part of the apparatus to the wall.
Figure 6:
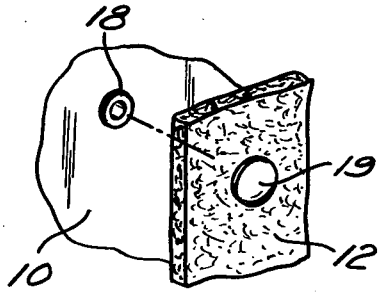
FIG. 6 is an enlarged perspective view indicating corner attachment with snaps.

I have indicated a square or rectangular panel 12 secured to surface 10 by a number of fasteners. If vertical surface 10 were a door, securing panel 12 with wood screws would be quite satisfactory. In the case of plasterboard wall 10, I show screws 14 in the corners and an expansion anchor type fastener 16 in the central portion (detailed in FIG. 3). The type of securement of panel 12 to wall 10 will be understood to be a matter of choice, i.e., in FIG. 6 it is shown with the use of male and female snap fastener parts 18, 19. Many users may not want to commit to use of wall 10 indefinitely for this purpose, which means panel 12 should not be bonded to wall 10 or the Velcro parts in panel 12 should not be bonded directly to wall 10. Whatever fastening means is used for a panel 12 later to be detached, the fastening means should do as little permanent structural damage to wall 10 as is consistent with sufficient strength to take the weights and forces applied by the feet to panel 12 in doing bent-knee situps.

Figure 7:
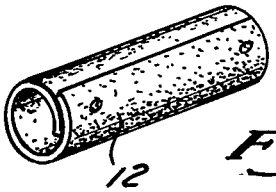
FIG. 7 is a perspective view of the equipment rolled up for storage or transportation.
Figure 4:
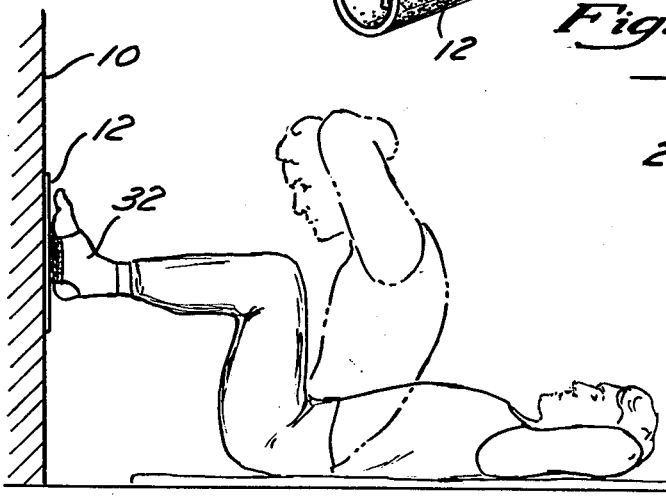
FIG. 4 is a side view showing the apparatus in use as the user performs bent-knee situps.

A suitable material for panel 12 is carpeting, such as outdoor or indoor-outdoor carpeting. For a material of limited strength such as carpeting, use of eyelets or grommets 22 to pass fasteners 14, 16 is advisable. Advantages of carpeting for panel 12 include the fact that panel 12 can be rolled as shown in FIG. 7, with Velcro parts inside, for shipment or storage. Other advantages include reasonable cost, cushioning foot comfort, low weight, attractiveness, easy securement of Velcro patches thereto, such as by bonding or sewing, easy installation of eyelets 22, simple fabrication by cutting carpeting into squares or rectangles, and no need for further finishing of carpeting surfaces. However, other panels 12 or other means of securing Velcro patches to a vertical surface 10 such as a wall can be substituted. There are cements available that are designed to bond particular types of Velcro to other surfaces.

I provide a first pair of Velcro patches 24 secured to the surface of panel 12 in spaced apart, juxtaposed disposition convenient for the spacing apart of feet in bent-knee situps. Two inch wide Velcro strips 24 spaced four inches apart are suitable. A length of each patch 24 of six inches is satisfactory and a twelve inch by twelve inch panel 12 is workable. Two inch wide material is specified as this is a standard width readily available. However, I would not exclude the possibility of using even a single patch 24 of six or eight inch Velcro width if that were available and suitably priced for this application.

Attached to the feet are a second pair of Velcro patches 30 which are suitably secured to the feet. The minimum securement of patches 30 would be a pair of bands going around the feet and positioning patches 30 on the soles of the feet. However, such bands would not very well support the weight of the feet, at least unless they were rather tight, and the securement would be better if one band went around the foot and another went around the ankle and the bands were connected together. In thinking about this and analyzing the problem of attaching Velcro patches 30 to feet, I realized that commercially available elastic foot and ankle supports 32 would be good for this purpose and especially if the longer "leg" 34 of these anklets, which normally goes around the ankle was put on the foot, and if the shorter "leg" 36 of the anklets, which normally goes around the foot, was put on the ankle. The reason to use the longer leg 34 on the sole of the foot is that it has a better length to accommodate the lengths of Velcro patches 30. Preferably, each Velcro patch 30 is about four and a half to five inches long and leg 34 in anklet 32 for a grown male is of similar length. In a smaller person, anklet 32 would be smaller and patches 30 would need to be shorter. Commercially available two inch wide Velcro material is suitable for patches 30. While patches could be bonded to anklets 32, sewing of the patches could be better adapted for laundering of anklets 32. The elastic foot supports commonly are made from Nylon or cotton and are ribbed and elasticized. Small, medium and large anklet sizes will fit a range of adult males. Preferably anklets 32 will fit the user snugly. The elastic foot supports or anklets could be thought of as a form of a sock, with toe and heel missing or as connected bands about foot and ankle.

If the patches 24 on the wall are somewhat longer than the patches 30 on the feet, then there will be added tolerance for misplacing of feet in pressing patches 30 to patches 24. Patches 30 do not have to be completely abutted to patches 24, but desirably most of the patches 30 will be engaged with patches 24.

Velcro type materials usually have hook and loop mating portions. I prefer that wall patches 24 be of Velcro hook type and that foot patches 30 be of Velcro loop type. The preference for Velcro hooks on the wall is partly that the hook patches are less conforming and hence work better on the flat wall panel 12 than they would on the foot. Secondly, if hook Velcro patches were used on socks 32, the hooks could become entangled with a carpet or rug.

Figure 5:
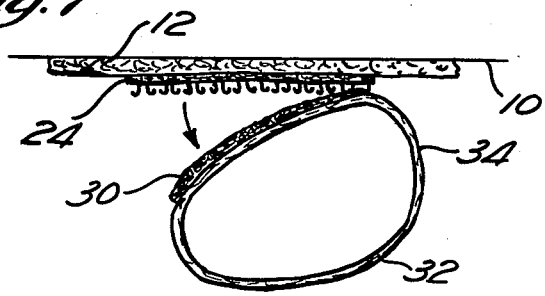
FIG. 5 is an enlarged end view indicating the preferred manner of disengaging one Velcro part from another. The view is from above, of the right foot.

The use of the Velcro patches on wall and feet provides an easily used, effective and economical way to attach the feet to a wall for bent-knee situps and for later detachment. FIG. 5 demonstrates the preferable manner of detaching pads 30 from pads 24 in which the feet or legs are rocked or pivoted to peel the Velcro hooks from the Velcro loops. If instead one tried to detach pads 24 and 30 all at once by pulling straight back on the feet, fasteners 14, 16, 18, 19 for panel 12 could tend to be pulled from wall 10.

In locating patches 24 on panel 12 relative to the floor, the proper distance can be estimated by measuring, with a tape or ruler, the distance from the hip bone to the mid knee along the outside of the leg. Final positioning can be obtained by having someone hold panel 12 while the user assumes the ninety-degree bent-knee position. It is desirable that the floor be carpeted or padded under the person doing bent-knee situps.

Those skilled in the art will understand how to do ninety-degree bent-knee situps and how to use my equipment. As known, the arms may be kept down on the sides or the arms may be disposed behind the neck or head, depending on the degree of difficulty desired in exercising. The user bends at the waist and attempts to touch his chin or elbow on his knee, etc.

Having thus described by invention, I do not wish to be understood as limiting myself for the exact construction shown and described. Instead, I wish to cover those modifications of my invention that will occur to those skilled in the art upon learning of my invention and which are within the proper scope thereof.

I claim:

1. Exercising apparatus, comprising:

(a) a pair of socks having on their soles a first pair of loop-type Velcro patches, each sock being an elastic foot supporter with an open toe and an open heel and corrected bands around foot and ankle, and (b) a flexible carpet-like panel adapted to detachably abut and secure to a vertical surface such as a wall in flat condition in use and to roll for transportation and fastener means operative to secure said panel to said vertical surface, a second pair of spaced-apart, juxtaposed hook-type Velcro patches secured to the face of said panel to detachably secure to said first pair of Velcro patches, whereby the exercising apparatus can be used in bent-knee situps to secure the feet to said vertical surface above the floor level.

2. Exercising Apparatus, comprising:

(a) a pair of flexible fabric socks having on their soles a first pair of Velcro patches, and (b) supporting means coacting with said pair of socks including means securing said supporting means to a vertical surface such as a wall at a location spaced from the floor and including second Velcro means operative to coact with said first pair of Velcro patches to detachably secure said first pair of Velcro patches to said second Velcro means, whereby the exercising apparatus can be used in bent-knee situps to secure the feet to said vertical surface above the floor level.

3. The subject matter of claim 2 in which said first pair of Velcro patches has loop means and said second Velcro means consists of a second pair of spaced-apart patches having hook means.

4. The subject matter of claim 2 in which each sock has a first flexible fabric annular section to go around the user's foot and a second flexible fabric annular section to go around the user's ankle.

5. The subject matter of claim 2 in which said first pair of Velcro patches has loop means and said second Velcro means has hook means.

6. The subject matter of claim 2 in which said supporting means includes a detachable flexible fabric carpet-like panel adapted to abut said vertical surface in flat condition in use and to roll for transportation.

7. The subject matter of claim 2 in which said supporting means includes a detachable panel adapted to abut said vertical surface and said second Velcro means consists of a second pair of spaced-apart, juxtaposed Velcro patches mating with said first pair of Velcro patches in use of the exercising apparatus.

8. Exercising Apparatus, comprising:

(a) a pair of socks having on their soles a first pair of Velcro patches, (b) supporting means coacting with said pair of socks including means securing said supporting means to a vertical surface such as a wall at a location spaced from the floor and including second Velcro means operative to coact with said first pair of Velcro patches to detachably secure said first pair of Velcro patches to said second Velcro means, whereby the exercising apparatus can be used in bent-knee situps to secure the feet to said vertical surface above the floor level, (c) said supporting means including a detachable flexible fabric carpet-like panel adapted to abut said vertical surface in flat condition in use and to roll for transportation, and (d) said panel having corner and central eyelet means and fastener means in said eyelet means to secure said panel to said vertical surface.

9. The subject matter of claim 8 in which said fastener means in said central eyelet means is of expanding anchor type suitable for anchoring in plasterboard or the like.

10. Exercising apparatus, comprising:

(a) a pair of socks having on their soles a first pair of Velcro patches, (b) supporting means coacting with said pair of socks including means securing said supporting means to a vertical surface such as a wall at a location spaced from the floor and including second Velcro means operative to coact with said first pair of Velcro patches to detachably secure said first pair of Velcro patches to said second Velcro means, whereby the exercising apparatus can be used in bent-knee situps to secure the feet to said vertical surface above the floor level, (c) said supporting means including a detachable flexible fabric carpet-like panel adapted to abut said vertical surface in flat condition in use and to roll for transportation, and (d) said panel having corner snap fasteners for securing said panel to said vertical surface.

11. Exercising apparatus, comprising:

(a) a pair of socks having on their soles a first pair of Velcro patches, (b) supporting means coacting with said pair of socks including means securing said supporting means to a vertical surface such as a wall at a location spaced from the floor and including second Velcro means operative to coact with said first pair of Velcro patches to detachably secure said first pair of Velcro patches to said second Velcro means, whereby the exercising apparatus can be used in bent-knee situps to secure the feet to said vertical surface above the floor level, (c) each sock having a first annular section to go around the user's foot and a second annular section to go around the user's ankle, and (d) each sock having a standard elastic foot supporter with an open toe and an open heel and connected bands around foot and ankle.

* * * * *